United States Patent [19]

Percy

[11] 4,112,910

[45] Sep. 12, 1978

[54] PRE-LUBE DEVICE

[75] Inventor: Donald W. Percy, Londonberry, N.H.

[73] Assignee: Prelube Corporation, Derry, N.H.

[21] Appl. No.: 679,828

[22] Filed: Apr. 23, 1976

[51] Int. Cl.[2] ..... F01M 1/00

[52] U.S. Cl. ..... 123/196 S; 184/6.3

[58] Field of Search ..... 184/6.3; 123/196 M, 123/196 R, 196 S; 74/527

[56] References Cited

U.S. PATENT DOCUMENTS

| | | | |
|---|---|---|---|
| 2,007,360 | 7/1935 | Berger | 74/527 |
| 2,329,182 | 9/1943 | Boynton | 74/527 |
| 2,736,307 | 2/1956 | Wilcox | 184/6.3 |
| 2,867,203 | 1/1959 | Easton | 184/6.3 |
| 3,422,807 | 1/1969 | Waldecker | 184/6.3 |

FOREIGN PATENT DOCUMENTS

| | | | |
|---|---|---|---|
| 1,357,236 | 6/1974 | United Kingdom | 184/6.3 |

*Primary Examiner*—Ronald H. Lazarus
*Attorney, Agent, or Firm*—William D. O'Reilly

[57] ABSTRACT

A pre-lube device for internal combustion engines. A quantity of oil, heated if desired, is stored in a chamber. Upon activation of the ignition for the engine, an electromagnet is energized, releasing a holding device for a coiled power spring which allows the spring to fully extend. The extending spring drives a piston located within the oil chamber to a fully extended position, thereby forcibly evacuating the oil from the chamber through a conduit into and throughout the engine galley in order to fully lubricate the engine prior to start, for the purpose of minimizing wear on the engine.

6 Claims, 4 Drawing Figures

PRE-LUBE DEVICE

BRIEF SUMMARY OF THE INVENTION

This invention relates to a device which lubricates an engine prior to start. It is well known that the greatest wear on an engine occurs during starting, particularly in cold weather or after prolonged periods of inactivity.

This is due to the fact that the engine oil pump is ordinarily driven by the engine itself, and therefore obviously cannot develop sufficient pressure to force the oil into the engine galley prior to the critically important initial strokes during which significant wear will occur at the bearing surfaces if they are not properly lubricated.

Inventors of prior pre-lube devices have long recognized the problem. For example, U.S. Pat. Nos. 1,872,279 issued Aug. 16, 1932 and 1,926,801, issued Sept. 12, 1933, discuss the large proportion of engine wear which occurs during the starting period in the absence of proper lubrication. More recently, each of U.S. Pat. Nos. 2,889,821 issued June 9, 1959, 3,138,221 issued June 23, 1964, and 3,425,404 issued Feb. 4, 1969 recognize and attempt to deal with the problem.

However, none of the known prior devices acceptably solve the problem because they are not capable of supplying under sufficient pressure a quantity of oil to all parts of the engine rapidly enough to effectively combat the problem of engine wear under all starting conditions.

The present invention is adapted to properly prelubricate the engine, even under extremely adverse starting conditions. For example, if the operator of a vehicle fitted with my pre-lube device desired to drive away immediately upon starting the vehicle, he could do so without harming the engine, even if he did so after the vehicle had been left outside throughout the night in temperatures of −20° Fahrenheit. This is true whether or not the oil in the chamber of the pre-lube device is preheated.

In order to achieve these results, the present invention is adapted to generate at least 900 pounds of driving pressure on a piston head which is positioned in the chamber, thereby rapidly forcing oil from the pre-lube chamber throughout the engine galley after the ignition key is turned to the first stage, but before the second stage of a so-called "two stage" ignition system is activated. This pressure is generated upon activation of the ignition system by the release of a powerful spring abutting the piston head which is normally held in a fully coiled position by a locking device capable of securing the spring under loads of at least 900 pounds of pressure. It is therefore apparent that it is not possible to start the engine with an inadequate amount of lubrication in the engine galley, since the pre-lubrication process is complete virtually instantaneously after the first stage of the ignition process occurs — clearly before the second stage ignition commences. Thus, engine wear is minimized, even under extremely adverse starting conditions.

DETAILED DESCRIPTION

Figure 1:
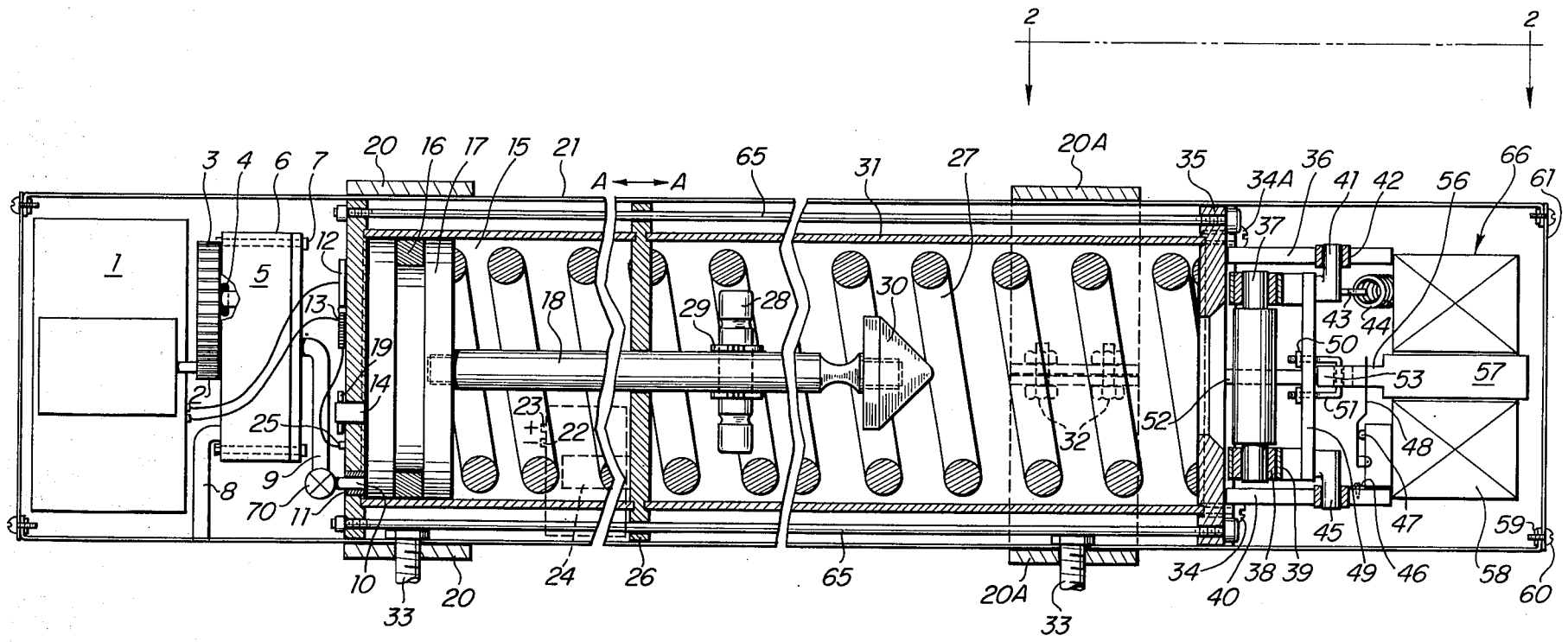
FIG. 1 is a plan, partial cross-sectional view of the pre-lube device which depicts the fully extended position of the spring and piston upon evacuation of the oil chamber.
Figure 2:
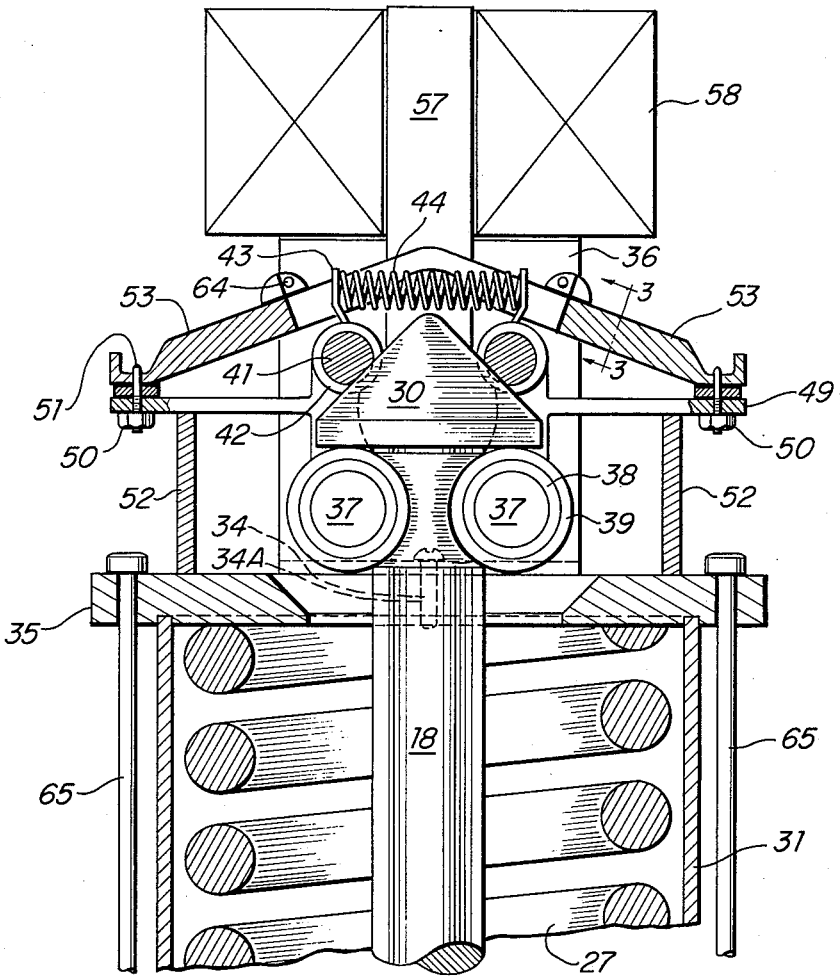
FIG. 2 is a vertical cross-sectional view of the holding device portion of FIG. 1, taken along line 2—2 thereof depicting the fully retracted position of the spring and piston upon charging of the oil filter.
Figure 3:
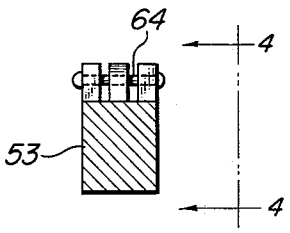
FIG. 3 is a vertical cross-sectional view of the hinge pin of the tripping arm of FIG. 2 taken along lines 3—3 thereof.

Referring to FIGS. 1 and 2 of the drawings, a twelve or twenty-four volt D.C. motor 1 is adapted to drive a gear pump 5, situated within a housing 6, through a motor pinion gear 2 and pump drive gear 3. An oil seal 4 prevents oil leakage from the gear pump. The housing assembly is secured by tie bolt and nut 7. The gear pump is adapted to pump oil from the oil pan or crankcase of the engine (not shown) through suction line or conduit 8. Conduit 9 comprises a discharge line from the pump to oil chamber 15 which houses a piston 17. Check valve 70 prevents oil from chamber 15 from flowing back through conduit 9 when oil is being forcibly evacuated from chamber 15 to the engine galley (not shown) through discharge line or conduit 10. A plurality of bushings 11 secure end plate 63 of the oil chamber 15. Starter switch 14 which has a microswitch 19 and contact 25 associated therewith, is connected to motor 1 through microswitch 13 and relay 12. Gasket 16 prevents oil leakage from oil chamber 15.

Piston 17 has secured thereto a locking rod 18 having a ¾ inch diameter. Locking rod 18 is slidably moveable within locking rod guide 28 and snap ring 29. At the opposite end of rod 18 from piston 17 is secured a cone-shaped locking rod head 30.

The outside casing 21 of the pre-lube device is readily attachable to the engine block (not shown) by means of mounting clamps 20 having mounting clamp bolts 32 affixed thereto. The entire pre-lube device may be easily and rapidly attached to the engine block by means of mounting clamps 20 being secured to one or more engine flange and oil pan bolts 33 (see FIG. 1).

A heating unit 24, having negative and positive terminals 22 and 23 respectively, may be employed to heat the oil in chamber 15 to a temperature of 180° Fahrenheit. It should be understood that while it is desireable to heat the oil in chamber 15, it is not essential to do so, since the pre-lube device is designed to function effectively with or without heated oil. A 110 volt AC power supply may be used if an independent power source which will not drain the vehicle battery is desired, or terminals 22 and 23 can be connected to the battery if DC power is utilized. A standard control (not shown) provides thermostatic regulation for oil chamber 15, enabling one to control the temperature of the oil.

Adapter ring 26 separates oil chamber 15 from power chamber 31. In order to accomodate the varying prelubrication requirements of larger and smaller engines, the capacity of oil chamber 15 may be increased or decreased by moving adaptor ring 26 back and forth along lines A—A. Mounted within power chamber 31 is power spring 27. Spring 27 is a one-half inch diameter coiled steel spring which abuts piston 17 at one end, coils around locking rod 18 and at its opposite end, abuts power chamber end plate 35. A total of four locking assembly vertical support flange screws 34 and 34-A are mounted to power chamber end plate 35, and tie bolts 65 are mounted to oil chamber end plate 63, thereby securing the respective chamber outside casing 21.

Referring to FIGS. 1 through 4 of the drawings, the holding assembly will now be described. The holding assembly is enclosed within outside casing 21 and end plate 61, which is attached to casing 21 by several end plate clips 59 and screws 60. Locking roller 37 has associated therewith four roller bearings 38. Roller 37 and bearings 38 are disposed within a housing 39. Left and right vertical supports for the locking assembly are designated at 36 and 40, respectively. Similarly, left and right support shafts for roller-bearing housing 39 are indicated by numerals 41 and 45, respectively, which support shafts have roller bearing 42 associated therewith.

Figure 4:
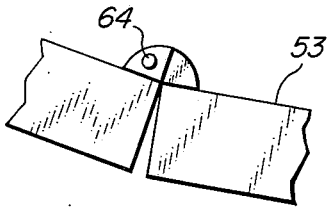
FIG. 4 is another vertical cross-sectional view of the hinge pin taken along lines 4—4 of FIG. 3.

Locking roller 37 is adapted to releaseably receive head 30 of locking rod 18 through an opening in power chamber end plate 35. Mounted to support shaft 41 is a support 43 for locking roller spring 44. Solenoid 66, comprising a plunger 57, windings 58, and electric solenoid piston connection 56, possesses a thrust of ten pounds at dead start. A tripping arm 53 has a hinge pin 64 attached thereto in such a manner that arm 53 is adapted to bend as shown in FIG. 4 of the drawings. Tripping plate 49 is mounted to arm 53 by U-bolt 51 and U-bolt lock nut 50. Support leg 52 supports tripping plate 49. Micro stop switch 47 is connected to the positive and negative terminals of a relay to DC motor 1 by a pair of electric leads (not shown). Micro switch control level 48 is mounted to switch 47 which is in turn affixed to micro switch mounting bracket 46.

The operation of the preferred embodiment of the invention will now be described. When the ignition of the vehicle (not shown) is turned to stage one, solenoid plunger 57 and solenoid piston connection 56 are energized, hinge pin 64 of tripping arm 53 moves as shown in FIG. 4 of the drawings. The hinged movement of the tripping arm 53 causes tripping plate 49 to move outwardly in an extremely rapid fashion, thereby causing locking roller 37 to move in a similar fashion, which releases locking rod head 30 and coiled power spring 27. Spring 27 uncoils at a pressure of at least 900 pounds, driving piston 17 down into oil chamber 15, thus forcibly evacuating the oil through conduit 10 (which may be a ½ inch diameter line) into the engine galley at a pressure of 200 pounds.

When spring 27 and hence piston 17 reach the fully extended position, starter switch 14 is energized, activating micro switch 13 and relay 12 to motor 1. Motor 1 drives gear pump 5 which draws oil from the engine oil pan through conduit 8 to line 9 and into oil chamber 15. Since gear pump 5 is pumping this oil at a pressure of approximately 1000 pounds, spring 27 retracts as oil fills chamber 15 until locking rod head 30 is fully locked into restarted position by locking roller 37, at which point micro switch control lever 48 contacts micro stop switch 47, which through relays deenergizes motor 1, shutting off pump 5. At this point, the pre-lube device is ready for another operating cycle.

Although the preferred embodiment of the invention describes a pre-lube device which is intended to be installed on a truck engine such as those manufactured by Mack, Cummins, Detroit and so forth, it should be understood that the inventive principles are applicable to a range of internal combustion engines. By way of example, pre-lube device may be installed on an automobile engine. Since most car engines have a working pressure of 30 pounds, whereas most trucks have an engine working pressure of 60 pounds, it is apparent that one may modify the amount of pressure required to effectively evacuate the pre-lube oil chamber in order to properly lubricate the engine. What is important is the fact that the present invention is designed to minimize engine wear under all starting conditions, including the extremely adverse conditions previously described in the Brief Summary of the Invention.

It will be apparent to those skilled in the art that other modifications may be made without departing from the spirit of the invention, or from the scope of the annexed claims.

What is claimed is:

1. A device for lubricating an internal combustion engine upon ignition and prior to the start thereof, comprising:

chamber means for storing a quantity of oil of sufficient amount to prelubricate said engine, said chamber means being adapted for fluid communication with said engine, pump means in fluid communication with an oil pan of the engine and with said chamber means for the supplying oil under pressure to said chamber, rigid moveable piston means disposed within said chamber for evacuating oil from the chamber to said engine, said piston means having an elongated rod associated therewith; said piston rod having a head mounted to an end surface thereof, power chamber means disposed adjacent to said oil chamber means, said power chamber means including power spring means, at least one surface of which abuts said piston means for moving the piston means under pressure within said oil chamber means in order to evacuate oil therefrom, and locking means for releaseably receiving said piston rod head, comprising moveable roller means adapted to receive and secure said head said roller means comprising multiple rollers adapted to move radially outwardly from the diameter of said piston rod and adapted to secure said head around the circumference thereof, in order to secure said piston means associated therewith against movement such that when said ignition is actuated it causes movement of said roller means thereby releasing said head and said power spring means, whereby said piston means is moved under pressure in such a manner as to evacuate the oil from said chamber into and throughout said engine in order to lubricate the engine prior to start.

2. The device of claim 1 in which said locking means includes a hinged arm associated with said roller means which is adapted to move said roller means upon actuation of said ignition for the purpose of releasing said piston rod-head.

3. The device of claim 2 in which said hinged arm is in moveable contact with said roller means by a plate secured at one surface to said arm and at another surface to a housing for said roller means.

4. The device of claim 3 in which a spring means is associated with said roller means, said spring means being mounted to a support for said roller housing, said spring means being adapted to lock the roller means to said piston rod-head.

5. The device of claim 4 including solenoid means adapted to be energized upon actuation of said ignition, whereby the said movement of a plunger in said solenoid causes said hinged arm to bend, thereby moving said plate and said roller means, whereby said piston rod head is released.

6. The device of claim 1 in which said power spring is adapted to generate at least 900 pounds of pressure on said piston means upon release of said piston rod head, whereby oil is forcibly evacuated from said chamber into said engine substantially instantaneously upon release of said head, in order to lubricate the engine prior to start.

* * * * *